US006934499B1

(12) United States Patent
Sato et al.

(10) Patent No.: US 6,934,499 B1
(45) Date of Patent: Aug. 23, 2005

(54) IMAGE FORMING APPARATUS

(75) Inventors: Noriaki Sato, Shizuoka-ken (JP); Hideo Nanataki, Kanagawa-ken (JP); Tomio Noguchi, Shizuoka-ken (JP); Naoki Enomoto, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/668,302

(22) Filed: Sep. 24, 2003

(30) Foreign Application Priority Data

Sep. 25, 2002 (JP) ..... 2002-278918

(51) Int. Cl.[7] ..... G03G 15/16
(52) U.S. Cl. ..... 399/302; 399/101; 399/308
(58) Field of Search ..... 399/302, 308, 399/303, 101, 297; 347/116

(56) References Cited

U.S. PATENT DOCUMENTS 5,732,310 A 3/1998 Hiroshima et al. ..... 399/101
6,160,978 A * 12/2000 Tsuruoka et al. ..... 399/302 X
2002/0114633 A1 8/2002 Sawanaka et al. ..... 399/9

FOREIGN PATENT DOCUMENTS

JP 11-161043 6/1999
JP 2002-258626 A * 9/2002

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes a first image bearing member carrying a toner image, and a movable second image bearing member carrying a toner image. The toner image on the first image bearing member is transferred to the second image bearing member at a first transfer portion, and the toner image on the second image bearing member is transferred to a transfer material at a second transfer portion. The apparatus also includes a charging member contacting the second image bearing member arranged on a downstream side of the second transfer portion and on an upstream side of the first transfer portion in a moving direction of the second image bearing member, and a mark portion having a thickness and being formed on the second image bearing member. A contact region between the charging member and the second image bearing member does not overlap with the mark portion in a direction perpendicular to the moving direction of the second image bearing member.

25 Claims, 7 Drawing Sheets

IMAGE FORMING APPARATUS

BACKGROUND OF THE INVENTION

1. Field of the Invention

This invention relates to an image forming apparatus such as a photocopier and a printer and, more particularly, to an apparatus at which a mark for detecting a position is formed on a moving body.

2. Description of Related Art

In image forming apparatuses, various methods such as an electrophotographic method, a thermal transfer method, an inkjet method are used conventionally. Apparatuses using the electrophotographic method, inter alia, are excellent in comparison with other methods in terms of high speed, high image quality, and noiselessness, and are widely used as image forming apparatuses such as photocopies and page printers. With the electrophotographic method, images made of toner particles are formed on a transfer material by utilizing electrostatic force, and the toner image is then melt and fixed onto the transfer material according to beat and pressure applied by a fixing device, and enters into a stable state. Recent image forming apparatuses of the electrophotographic type have features of advanced functions such as color application and high speed.

FIG. 6 is a schematic diagram showing an image forming apparatus using an electrophotographic method as a prior art. A multicolor image forming apparatus using an intermediate transfer method is shown in FIG. 6. In the drawing, a photosensitive drum 101 as an image bearing member is uniformly charged with a charging roller 102, and scanning a scanning beam 104 with an exposure optical system 103 forms a latent image. A toner image is formed to the latent image upon development with a developing device 105, having a developing roller 105*a* facing the photosensitive drum 101, attached to a rotary member 122, and is primarily transferred onto an intermediate transfer belt 109 as an intermediate transfer body from a primary transfer roller 110, which is charged by a power source 119, at a primary transfer nipping portion N1. The primary transfer remaining toner remaining on the surface of the photosensitive drum 101 after the primary transfer is removed by a photosensitive drum cleaner 117 having an elastic blade, and is contained in a waste toner container, not shown.

During the full color image formation (or full color mode), the above steps are sequentially performed with respect to developing devices 105 to 108 of the respective colors in synchrony with the rotation of the intermediate transfer belt 109, thereby forming a color image overlapped with four colors on the intermediate transfer belt 109. It is to be noted that during the monochrome image formation (monochrome mode) the above steps are done only for the black developing device to reduce the throughput.

The toner image thus formed on the intermediate transfer body is transferred secondary to the transfer material P at once by a secondary transfer roller 111 at a secondary transfer nipping portion N2 as a position for secondary transfer. The toner remaining on the intermediate transfer belt after the secondary transfer, is removed by a intermediate transfer body cleaning mechanism (whose detail will be described below). Then, the toner image is melt and fixed to the transfer material P in application of heat and pressure at a fixing device 121, and the transfer material is delivered to the exterior of the apparatus to end the image formation.

It is to be noted that the intermediate transfer belt is tensioned among a tension roller 116, a drive roller 115, and a secondary transfer opposing roller 112. A position detection mark (hereinafter referred to as "detection mark") 145 for detecting the position of the belt is adhered to an end of the belt, and a detecting sensor 146 is arranged at a position detectable of the detection mark near the intermediate transfer belt. The operation timings of the respective portions in the apparatus are determined based on the timing that the detecting sensor 146 detects the detection mark 145 to form the images at a prescribed position on the intermediate transfer belt.

So called tandem type color image forming apparatuses, other than the above apparatuses, have been known in which an image forming station containing such as a photosensitive drum and a developing device and being capable of developing a monochrome toner image, is provided independently for each color and in which such image forming stations are disposed on the periphery of the intermediate transfer belt. In the tandem method, the intermediate transfer body surface sequentially passes through the respective image forming stations to primarily transfer the respective toner images in an overlapping manner on the intermediate transfer body, thereby forming the full color image on the intermediate transfer belt. The secondary transfer and fixing operation, which are done subsequently, are performed in the same way as the prior art described above.

Next, the cleaning mechanism for intermediate transfer body is described. Secondary transfer remaining toners remaining as not transferred to the transfer material P are attached to the intermediate transfer belt 109 at a state that the secondary transfer step is completed. Conventionally, a remaining toner charging roller 131 is disposed at the intermediate transfer belt 109, and the charging roller charges the toner to be at a plus polarity as the polarity opposite to the toner's original charging polarity (charging polarity after toner development). The charged secondary transfer remaining toner is then transferred to a photosensitive drum 101 at a primary transfer nipping portion N1 as the primary transfer position and is removed from the intermediate transfer belt 109. It is to be noted that the secondary transfer remaining toner moved onto the photosensitive drum 101 is removed by the photosensitive drum cleaner 117 in substantially the same manner as the primary transfer remaining toner.

With this cleaning mechanism, if the charged amounts possessed by the respective particles of the charged secondary transfer remaining toner are not substantially even, adequate cleaning capability may not be obtained. The toner particles having a low charge amount receive weak electrostatic force from the electric field formed at a primary transfer nipping portion N1, and are transferred not easily to the photosensitive drum 101. The toner particles having a high charge amount receive large mirror reflection force from the intermediate transfer belt 109, and are therefore transferred not easily to the photosensitive drum 101 as a matter of course.

In a prior art, a bias in which an alternative current voltage is convoluted to a direct current voltage is used as the bias applying to the remaining toner charging roller 131 from a power source 137. This bias is excellent in ability for uniformly charging toners in comparison with the direct current bias, so that the respective charging amounts possessed by the respective toner particles can be made substantially uniform, and so that the apparatus can obtain adequate cleaning capability.

When the remaining toner charging roller 131 being applied with the above alternative voltage charges the secondary transfer remaining toner, however, toner scattering may occur around a contacting portion N3 between the remaining toner charging roller 131 and the intermediate transfer belt 109, thereby possibly messing up the interior of the apparatus. The secondary transfer remaining toner repeats jumping between the remaining toner charging roller 131 and the intermediate transfer belt 109 at the contacting portion N3 upon reception of the influence of the alternative current voltage. During this jumping process, although the respective toner particles of the secondary transfer remaining toner are charged at the positive polarity uniformly, the particles particularly with a lower charged amount among the secondary transfer remaining toner may not reach the remaining toner charging roller 131 and cannot come back to the intermediate transfer belt 109. According to the gravity and air flow caused by the rotation of the intermediate transfer belt 109, particles may float or drop down, thereby causing toner scattering.

To solve this problem, a method has been devised in which the secondary transfer remaining toner is charged at a plus polarity prior to charging operation by means of the remaining toner charging roller 131 in use of an auxiliary charging member 140 to which direct current voltage from a power source 141 not causing any scattering only applies. This renders the toner having a low charging amount which otherwise maybe scattered near the contact N3 of the remaining toner charging roller, so applied with an adequate charging amount in advance as not to be scattered, so that toner scattering hardly occurs. It is to be noted that opposing electrodes 132, 135 coupled to the ground level are formed on back surfaces of the remaining toner charging roller 131 and the auxiliary charging member 140 via the intermediate transfer belt 10 to raise charging efficiency.

Where the first charging means (auxiliary charging roller) contacting to the surface of the intermediate transfer belt, as an auxiliary charging member, is used, however, the following problems occur as illustrated in FIG. 7. FIG. 7 is a cross section around the intermediate transfer belt 109 at the auxiliary charging member 140.

When the detection mark 145 on the intermediate transfer belt 109 passes though the contact nipping portion between the auxiliary charging member 140 and the opposing electrode 135, if the auxiliary charging member 140 rides on the detection mark 145 and if the opposing electrode 135 supports the portion of the intermediate transfer belt at which the detection mark 145 is located, a portion of the roller may come afloat from the intermediate transfer belt, thereby rendering toner scattering and cleaning defects occur due to uncharged transfer remaining toner at that portion.

Such floating of the auxiliary charging member 140 remarkably happens especially where the auxiliary roller has a high hardness, more specifically, where the roller has a hardness of 45 degrees or more on JIS-A hardness scale (i.e., hardness of the roller single measured directly with a JIS A hardness measuring device), and further likely occurs where the pressure (contact pressure) pushing the auxiliary roller or the intermediate transfer belt is weak or where the detection mark has a thickness of 30 microns or more.

In a meantime, the parts in the apparatus are sought to be compact and made with lower costs according to high demands on compact and inexpensive apparatuses these days. It is advantageous to make the hardness higher to satisfy the durability and strength with a more inexpensive roller. Moreover, where the roller is made with a smaller diameter, the elastic layer is reduced to inevitably render the roller harder, and since the strength is lowered, it is required to reduce the contact pressure to the intermediate transfer belt (or the opposing electrode) so as not first charging means (the auxiliary charging roller) as far as not subjecting to occurrence of floating and can be used, so that improvement on the above point is desired.

SUMMARY OF THE INVENTION

It is an object of the invention to provide an image forming apparatus preventing a charging means from floating and preventing charging defects from occurring.

It is another object of the invention to provide an image forming apparatus including: a first image bearing member for carrying a toner image; and a movable second image bearing member for carrying a toner image, wherein a toner image on said first image bearing member is transferred to said second image bearing member at a first transfer portion, and the toner image on said second image bearing member is transferred to a transfer material at a second transfer portion, and further including: a charging member contacting to said second image bearing member and being arranged on a downstream side of said second transfer portion and on an upstream side of said first transfer portion in a moving direction of said second image bearing member; and a mark portion having a thickness and being formed on said second image bearing member, wherein a contact region between said charging member and said second image bearing member does not overlap with said mark portion in a direction perpendicular to a moving direction of said second image bearing member.

It is yet another object of the invention to provide an image forming apparatus including: a first image bearing member for carrying a toner image; and a movable second image bearing member for carrying the toner image, wherein a toner image on said first image bearing member is transferred to said second image bearing member at a first transfer portion, and the toner image on said second image bearing member is transferred to a transfer material at a second transfer portion, and further including: a charging member contacting to said second image bearing member and being arranged on a downstream side of said second transfer portion and on an upstream side of said first transfer portion in a moving direction of said second image bearing member; an opposing member opposing to said charging member via said second image bearing member and contacting to said second image bearing member and; a mark portion having a thickness and being formed on said second image bearing member, wherein a contact region between said opposing member and said second image bearing member does not overlap with said mark portion in a direction perpendicular to a moving direction of said second image bearing member.

Further objects of the invention will be apparent from the following description.

DETAILED DESCRIPTION OF THE PREFERRED EMBODIMENTS

Figure 1:
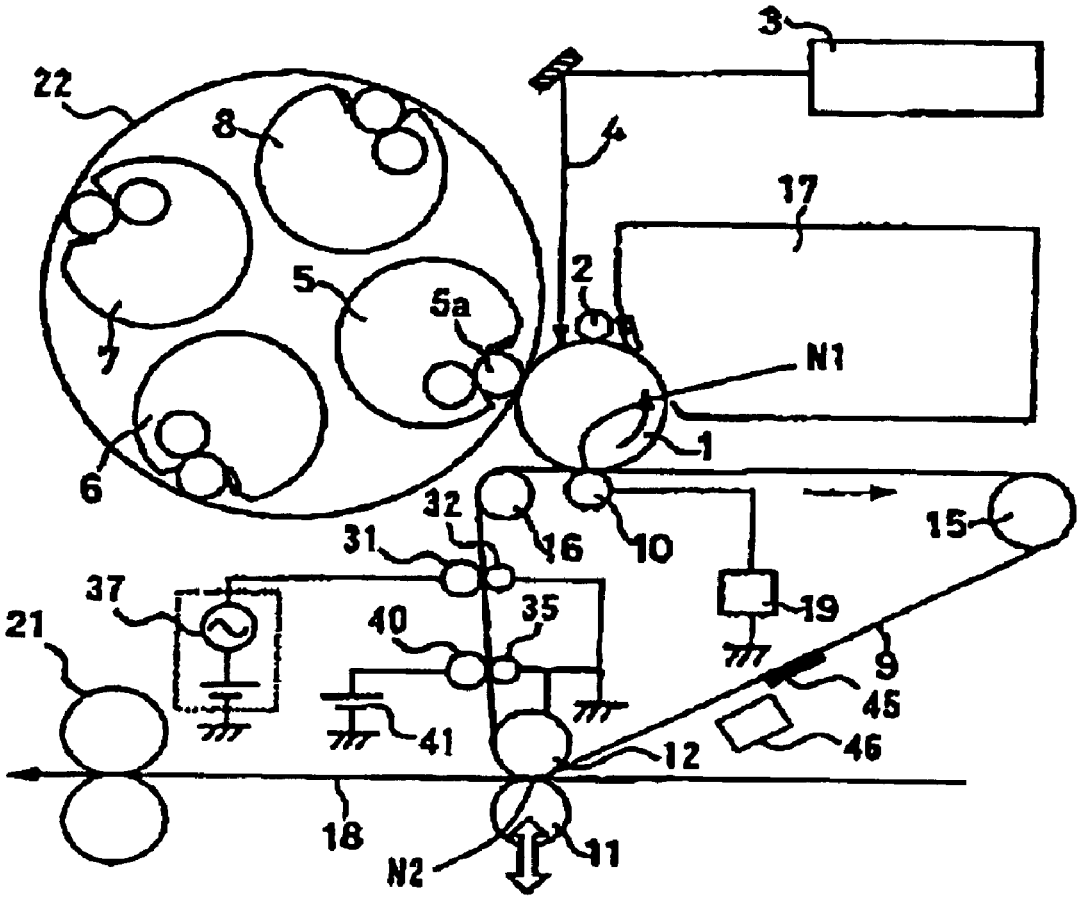
FIG. 1 is a diagram showing an image forming apparatus as an embodiment of the invention.

Referring to the drawings, embodiments according to the invention are described.

[First Embodiment]

FIG. 1 is a diagram showing an image forming apparatus as an embodiment of the invention. First, the entire structure of the image forming apparatus is described in detail, and then an intermediate transfer body cleaning mechanism including a featured portion in this embodiment is described in detail.

[Entire Structure]

First, referring to FIG. 1, the entire structure of the image forming apparatus is described. The image forming apparatus shown in FIG. 1 uses an electrophotographic method and is a multicolor printer using an intermediate transfer method.

In FIG. 1, a photosensitive drum 1 serving as a first image bearing member is driven to rotate in a direction shown with an arrow, and the surface thereof is applied with a minus charge by a charging roller 2 to be charged at −600 V uniformly. An exposure optical system 3 radiate scanning beam 4 controlled emitting based on image data to the surface of the photosensitive drum 1, and a latent image is formed upon removal of the minus charges. It is to be noted that the potential of the latent image portions is about −200 V. The latent image becomes a visualized image developed with developing devices 5 to 8 for respective colors. The developing devices 5 to 8 for the respective colors contains toners serving as developing agents in black, magenta, cyan, and yellow, and are attached to a rotary member 22. The respective developing devices 5 to 8 face to the photosensitive drum 1 by revolution of the rotary member 22 by 90 degrees, and the latent images on the photosensitive drum 1 are developed with the toners of the respective colors. It is to be noted that FIG. 1 illustrates a situation that the black developing device is disposed at the developing position.

A toner charged at a negative polarity is supplied at a prescribed amount on a developing roller 5*a* opposing the photosensitive drum 1, and a developing bias applies to the developing roller 5*a* from a power source, not shown. By setting the developing bias to a proper level between the charging potential and the latent image (exposing position) potential, a phenomenon that the toner is selectively attached to the latent image on the photosensitive drum 1 can be created. The monochrome toner image formed thus in the photosensitive drum 1 is primarily transferred sequentially onto intermediate transfer belt 9 serving as a intermediate transfer body at a first transfer nipping portion N1 as a first transfer portion.

The intermediate transfer belt 9 serving as a second image bearing member is suspended with a secondary transfer opposing roller 12, a drive roller 15, and a tension roller 16, and is driven to rotate in a direction shown with an arrow at a speed substantially the same as the photosensitive drum 1. A transfer bias voltage (200 V to 700 V) is applied to a primary transfer roller 10 from a power source 19. Primary transfer remaining toner remaining on the surface of the photosensitive drum 1 after the primary transfer is removed by a photosensitive drum cleaner 17 having an elastic blade and is contained in a waste toner container, not shown.

During a full color image formation (full color mode), the above steps are sequentially performed at the respective color developing devices 5 to 8 in synchrony with rotation of the intermediate transfer belt 9, thereby forming a color image overlaid of four colors on the intermediate transfer belt 9. It is to be noted that during a monochrome image formation (monochrome mode), the steps are performed only for the black developing device to reduce the throughput.

Where the full color image or the monochrome image is thus formed on the intermediate transfer belt 9, a secondary transfer roller 11 comes, at a secondary transfer nipping portion N2 as a second transfer portion, in contact with a back surface of the transfer material to be conveyed along a sheet conveying path 18, and the image is secondarily transferred at once to the transfer material with a supplied bias voltage (+1 kV) having a plus polarity, remaining on the intermediate transfer belt after the secondary transfer is removed by an intermediate transfer body cleaning mechanism as described below. The transfer material P carrying not yet fixed toner images of four colors on the surface thereof upon the secondary transfer, is conveyed to a fixing device 21, and image formation is completed upon fixing the toner image on the surface.

As such an intermediate transfer belt 9, used is, e.g., a resin film belt such as PVDF, polyamide, polyimide, PET nylon, and polycarbonate having a normal thickness of 60 microns to 300 microns and a volume resistivity of about $10^7$ Ωcm to $10^{12}$ Ωcm, and a rubber belt in which a high resistance resin layer having good molding releasing property and a thickness of about several decades microns is formed on a low resistance rubber base layer having a thickness of 0.5 to 2 mm. It to be noted that resistance adjustment of the intermediate transfer belt is done with carbon ZnO, $SnO_2$, $TiO_2$, and other conductive filers. In this embodiment, as an intermediate transfer belt, used is a molded one in a belt shape having a thickness of 80 microns made of a PVDF having a volume resistivity of $10^{10}$ Ωcm upon resistance adjustment with $SnO_2$.

It is to be noted that in this embodiment, a detection mark 45 serving as a mark portion for positional detection of the belt is adhered to an non-image forming region at an end of the intermediate belt, and a detecting sensor 46 is arranged at a position detectable of the detection mark near the intermediate transfer belt. To form images at a prescribed position on the intermediate transfer belt, operation timings of the respective members in the apparatus are determined based on the timing that the detecting sensor detects the detection mark on the intermediate transfer belt.

In this embodiment, a black seal member having a thickness of 30 microns or more, more specifically, 100 microns is used as the position detection mark 45, and is adhered to a non-image forming region on a side of the toner image carrying surface of the intermediate transfer belt. As the adhering method, exemplified are a method adhering by adhesive or pasting member, a method welding on the intermediate transfer belt using an ultrasound welding, and the like.

A reflection type photo sensor (i.e., of a type detecting with a photo receiving device reflection beam of the emitted beam of a light emitting device) is used for the detecting sensor 46. Passage of the black colored detection mark can be detected as a reduction of the reflectivity in comparison with the intermediate transfer belt having a high reflectivity near the white color.

Conversely, where the intermediate transfer belt 9 is in a dark color, a white mark or a silver color reflection plate may be used, and a detection mark to be detected by a sensor other than photo sensors may be used.

[Intermediate Transfer Belt Cleaning Mechanism]

The intermediate transfer belt 9 has, as a cleaning mechanism, a remaining toner charging roller 31 as a second charging means, an auxiliary charging roller 40 as a first charging means. With respect to the moving direction of the intermediate transfer belt 9, the auxiliary charging roller 40 is formed on a downstream side of the secondary transfer nipping portion N2 and on an upstream side of the primary transfer nipping portion N1, and the remaining toner charging roller 31 is formed on a downstream side of the auxiliary charging roller 40 and on an upstream side of the primary transfer nipping portion N1. The secondary transfer remaining toner not transferred to the transfer material P but remaining on the intermediate transfer belt after completion of the secondary transfer step as described above, is charged at a plus polarity as the polarity opposite to the charged polarity after development, and is transferred electrostatically to the photosensitive drum 1 by a transfer bias voltage at the primary transfer nipping portion N1 as a primary transfer position to be removed from the surface of the intermediate transfer belt 9.

In this embodiment, use as the auxiliary charging roller 40 is a molded one in which an elastic layer having a thickness of 1 mm made of a NBR rubber adjusted to have a volume resistivity of $10^8$ cm is formed on the periphery of a core metal having a diameter of 5 mm. The resistance adjustment of the elastic layer is done by dispersing carbon black: Although this auxiliary charging roller has a small diameter and is made inexpensive, the hardness of the roller surface is 75 degrees as not less than 45 degrees by a measurement according to the JIS-A method, and the MDI hardness is 79 degrees as measured by a micro hardness measuring device made by Kobunshi Keiki K. K. During the intermediate transfer belt cleaning operation, the auxiliary roller consists to the surface of the intermediate transfer belt with total pressure of 400 g, and is applied with a direct current voltage of +2 kV from the power source 41.

To the contrary, as the remaining toner charging roller 31, used is a member in which an elastic layer having the thickness of 3 mm made of a rubber member having a volume resistivity of $10^9$ Ωcm is formed on the periphery of a core metal having a diameter of 6 mm. The surface hardness is 35 degrees as not more than 45 degrees by the measurement according to the JIS-A method and 66 degrees by the MDI hardness. During the intermediate transfer belt cleaning operation, the remaining toner charging roller contacts to the source of the intermediate transfer belt 9 with total pressure of 900 g, and is applied from a power source 37 with a bias in which a direct current voltage of +1 kV is convoluted with an alternative current voltage of a sine wave having a frequency of 2 kHz and an amplitude of 2 kV.

It is to be noted that although arranged on a side of the toner image bearing member surface of the intermediate transfer belt 9, the remaining toner charging roller 31 and the auxiliary charging roller 40 have a mechanism for isolating the contact so as not to disturb the image on the intermediate transfer belt 9 prior to the secondary transfer and are isolated from the intermediate transfer belt 9 prior to the secondary transfer. Opposing electrodes 32, 35 are arranged at the back surface of the intermediate transfer belt 9 opposing the remaining toner charging roller 31 and the auxiliary charging roller 40, to raise the charging efficiency. The length of the opposing electrodes is arbitrary, and it is favorable to use a longer one than that of the respective charging rollers.

With the above structure, the transfer remaining toner is uniformly charged at the reverse polarity by the remaining toner charging roller, and can be turned accurately to the photosensitive drum 1. By the auxiliary charging roller 40, the remaining toner is charged and applied with charges in advance to the charging operation of the remaining toner charging roller, thereby suppressing to the minimum toner scattering at the remaining toner charging roller performing application of the alternative current voltage.

In this embodiment, the contact nipping region (hereinafter referred to as "nipping region in the axial direction) in a direction of the roller axes of the auxiliary charging roller 40 and the intermediate transfer belt 9 is wider than the image forming region on the intermediate transfer belt 9 but is always located inside the position of the position detection mark 45 on the intermediate transfer belt 9. That is, the contact region between the auxiliary charging roller 40 and the intermediate transfer belt 9 does not overlap with the detection mark in a direction perpendicular to the moving direction of the intermediate transfer belt 9. More specifically, the auxiliary charging roller 40 has a first end located on a side of said mark portion and a second end located on a side opposite to said first end in the direction perpendicular to the moving direction of the intermediate transfer belt 9 and the first end is located on a side closer to the second end with respect to the mark portion.

Adjustment of the nipping region in the axial direction is made by adjusting the length of the elastic layer formed on the periphery of the core metal of the auxiliary charging roller 40.

Figure 2:
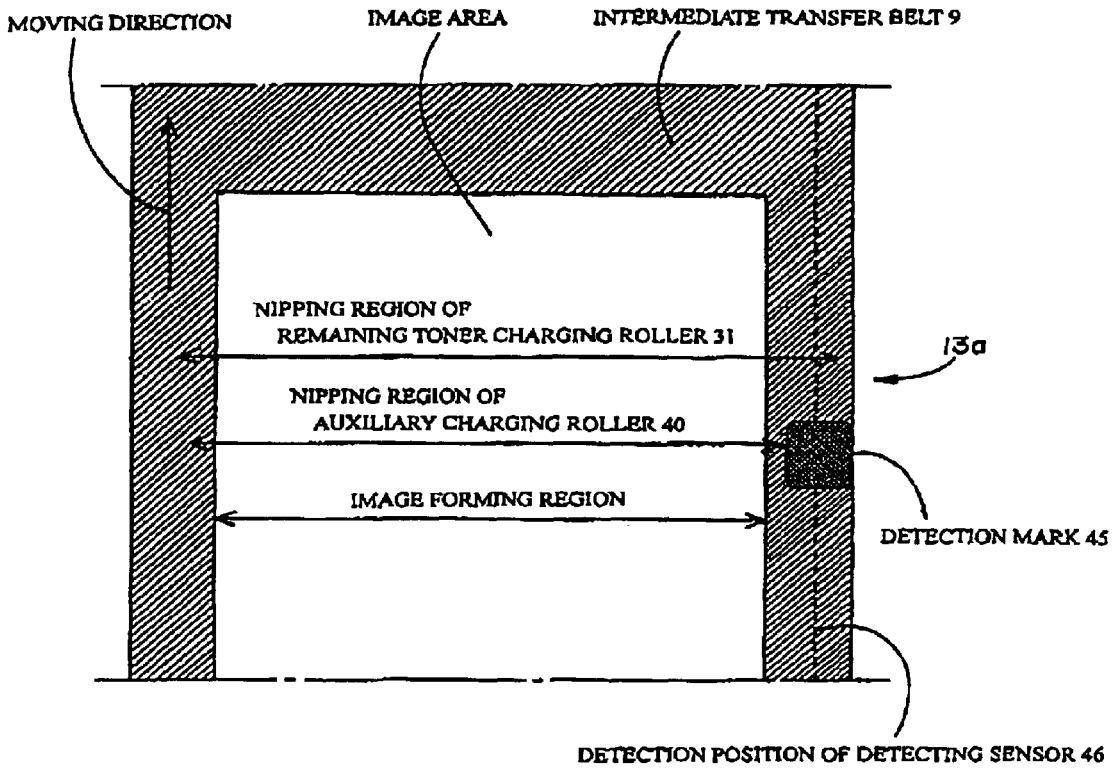
FIG. 2 is an illustration showing a length of a charging roller.

FIG. 2 schematically illustrates the above positional relation. In FIG. 2, with respect to the width of the intermediate transfer belt, shown respectively are the image forming region, the nipping region in the axial direction of the auxiliary charging roller 40, the nipping region in the axial direction of the remaining toner charging roller, the adhered position of the detection mark 45, and a detection position by the mark detecting sensor 46. It is to be noted that in this embodiment, the width of the image forming region is 210 mm; the width of the nipping region in the axial direction of the auxiliary charging roller 40 is 220 mm; and the width of the nipping region in the axial direction of the remaining toner charging roller 31 is 230 mm.

Thus, by constituting so that the nipping region of the auxiliary charging roller 40 does not pass through the detection mark 45, the auxiliary charging roller 40 does not ride on the detection mark, and the auxiliary charging roller does not float from the intermediate transfer belt 9 where a roller having a high hardness as the auxiliary charging roller is used or where the contact pressure to the intermediate transfer belt is weak, so that no charging defect occurs.

In this invention, it is to be noted that the contact nipping region between the remaining toner charging roller 331 and the intermediate transfer belt 9 is arbitrary.

Through the detection mark portion is located outside the image forming region and unlikely subject to messing done directly by toner, the detection mark portion may gradually get dirty through dropping or scattering in a small amount from the developing devices 5 to 8 or respective portions in the apparatus or through overload toner, waste toner or paper powder in a small amount leaked from the photosensitive drum cleaner 17, and then, may cause malfunctions in the detecting sensor 46.

In this embodiment, as a result of use of a type in which the JIS-A hardness of the roller surface is 45 degrees or lower and in which the contact pressure is relatively high, no charging defect occurs where the contact nipping portion of the remaining toner charging roller passes through the detection mark 45. This is because the elastic layer of the remaining toner charging roller can adsorb adequately the riding portion on the detection mark 45, because no floating occurs from the intermediate transfer belt 9, and because the remaining toner charging rollers 31 itself can obtain adequate charging property.

The remaining toner charging roller 31 is excellent in charging property since applied with the alternative current voltage, so that an adequate charging property is obtainable even where the remaining toner charging roller 31 is subject to floating more or less.

Thus, in this embodiment, the contact nipping region of the remaining toner charging roller 31 does cover the detection position on the detection mark 45, and namely, the contact region between the remaining toner charging roller 31 and the intermediate transfer belt 9 does overlap with the detection mark in a direction perpendicular to the moving direction of the intermediate transfer belt 9. More specifically, the remaining toner charging roller 31 has a first end located on a side of the detection mark 45 and a second end located on a side opposite to said first end in the direction perpendicular to the moving direction of the intermediate transfer belt 9 and the first end is located on a side opposite to the second end with respect to the detection mark 45.

According to this structure in this embodiment, the remaining toner charging roller 31 can charge the detection mark and the periphery of the belt, so that dirty portions on the detection mark or on the periphery of the intermediate transfer belt on which the detection mark is provided can be cleaned up.

As described above, according to the intermediate transfer body cleaning mechanism 13*a* of the embodiment, even where an inexpensive roller having a high durability and a high hardness, possibly made compacter, is used as the auxiliary charging roller, the auxiliary charging roller 40 does not ride on the detection mark to float from the intermediate transfer belt 9, so that no charging defect occurs.

[Second Embodiment]

Figure 4:
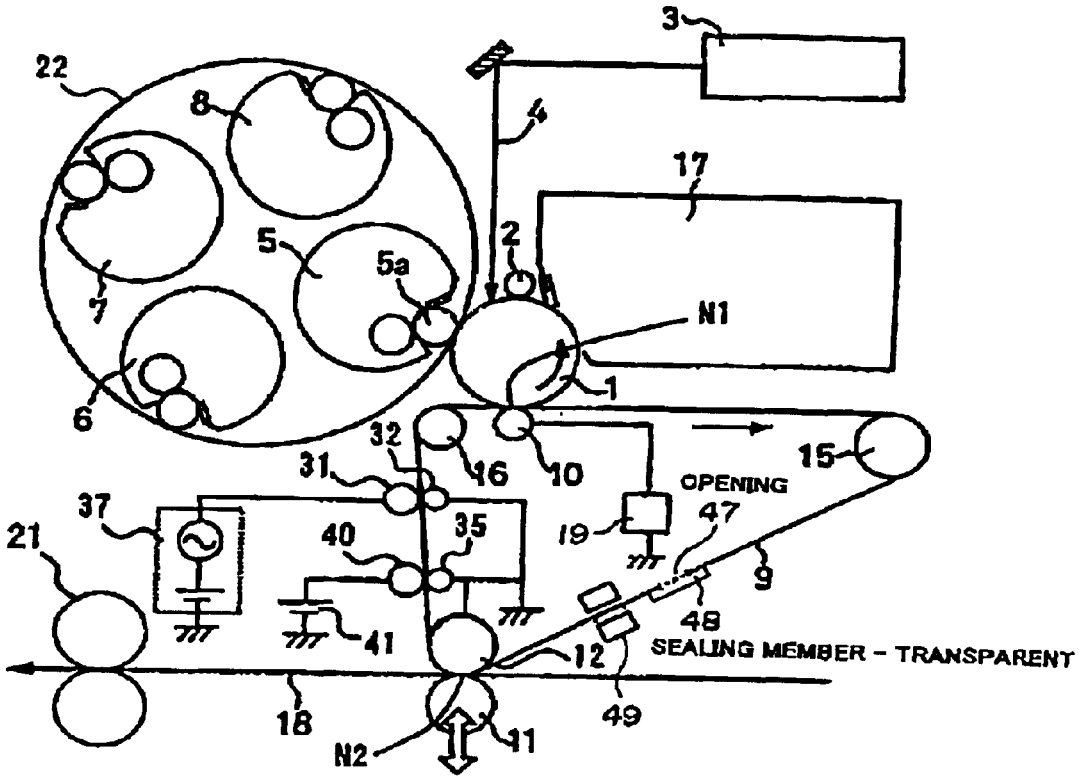
FIG. 4 is a diagram showing an image forming apparatus as yet another embodiment of the invention.

FIG. 4 shows the entire structure of the image forming apparatus in this embodiment. The image forming apparatus according to this embodiment and a schematic structure of the cleaning mechanism are substantially the same as in the first embodiment; the same reference numbers are assigned to portions that otherwise need duplicated descriptions, which are omitted; and different portions are described chiefly.

In the embodiment, a hole (detection hole) 47 as an opening of 4 mm square formed at a non-image forming region of the end 9 of the intermediate transfer belt 9 is arranged as a mark for position detection of the intermediate transfer belt, and a transmission type photo sensor (i.e., of a type detecting, with a photo receiving device, transmission beam of the emitted beam of a light emitting device) 49 is used for the detecting sensor. Because the beam transmits at a portion of the detection hole 47, the position can be detected. A transparent sheet member 48 of a medium or high resistance (having a volume resistance of $10^7$ Ωcm or higher) is attached on the detection hole 47. That is, the mark portion has the detection hole 47 and the sheet member 48. The reason that the transparent sheet member 48 is formed is to keep the strength of the portion of the detection hole 47 coming to have a weak strength and to avoid any tearing of the belt, as well as to prevent the bias current from leaking to the opposed portion though the detection hole 47. As the transparent sheet member 48, e.g., a PET sheet having a thickness of 50 microns is usable.

In this embodiment, the contact nipping region (hereinafter referred to as "nipping region in the axial direction) in a direction of the roller axes of the auxiliary charging roller 40 and the intermediate transfer belt 9 is always located inside the position of the transparent sheet member 48 formed on the detection hole 47 in the intermediate transfer belt 9.

Adjustment of the nipping region in the axial direction is made by adjusting the length of the elastic layer formed on the periphery of the core metal of the auxiliary charging roller 40. It is to be noted that in this embodiment, the width of the image forming region is 210 mm; the width of the nipping region on the axial direction of the auxiliary charging roller is 220 mm; and the width of the nipping region in the axial direction of the remaining toner charging roller is 230 mm.

Thus, the structure that the nipping region of the auxiliary charging roller 40 does not pass through the transparent sheet member 48 prevents the auxiliary charging roller 40 from riding over the sheet member 48, and even where a roller having a high hardness is used as the auxiliary charging roller 40 or where the contact pressure to the intermediate transfer belt 9 is weak, the auxiliary charging roller 40 does not float from the intermediate transfer belt 9, so that any charging defect hardly occurs.

As described above, according to the intermediate transfer body cleaning mechanism of this embodiment, advantages substantially the same as those in the above embodiment are obtained even where the detection hole 47 is used as a position detection mark of the intermediate transfer belt. That is, even where an inexpensive roller having a high durability and a high hardness, possibly made compacter is used as the auxiliary charging roller, the auxiliary charging roller 40 does not ride on the transparent sheet member to float from the intermediate transfer belt, so that no charging defect occurs.

[Third Embodiment]

The image forming apparatus according to this embodiment and a schematic structure of the cleaning mechanism are substantially the same as in the first embodiment as shown in FIG. 1; the same reference numbers are assigned to portions that otherwise need duplicated descriptions, which are omitted; and different portions are described chiefly.

In this embodiment, the detection mark 45 is formed at the non-image forming region on the intermediate transfer belt in the same manner as that in the first embodiment, and this apparatus has the auxiliary charging roller 40 and an opposing electrode 35 as an opposing member formed at an opposing position to the auxiliary charging roller via the intermediate transfer belt 9. The opposing electrode is made of a metal roller having a diameter of 10 mm. The opposing electrode 35 is formed on a surface opposite to the side of the toner image carrying surface.

In this embodiment, the contact nipping region (hereinafter referred to as "nipping region in the axial direction) in a direction of the roller axes of the opposing electrode 35 at the auxiliary charging roller 40 and the intermediate transfer belt 9 is wider than the image forming region but is always located inside the position of the position detection mark on the intermediate transfer belt 9. That is, the contact region between the opposing electrode 35 and the intermediate transfer belt 9 does not overlap with the detection mark 45 in a direction perpendicular to the moving direction of the intermediate transfer belt 9. More specifically, the opposing electrode has a first end located on a side of the detection mark 45 and a second end located on a side opposite to the first end in the direction perpendicular to the moving direction of the intermediate transfer belt 9 and the first end is located on a side closer to the second end with respect to the detection mark 45.

Figure 5:
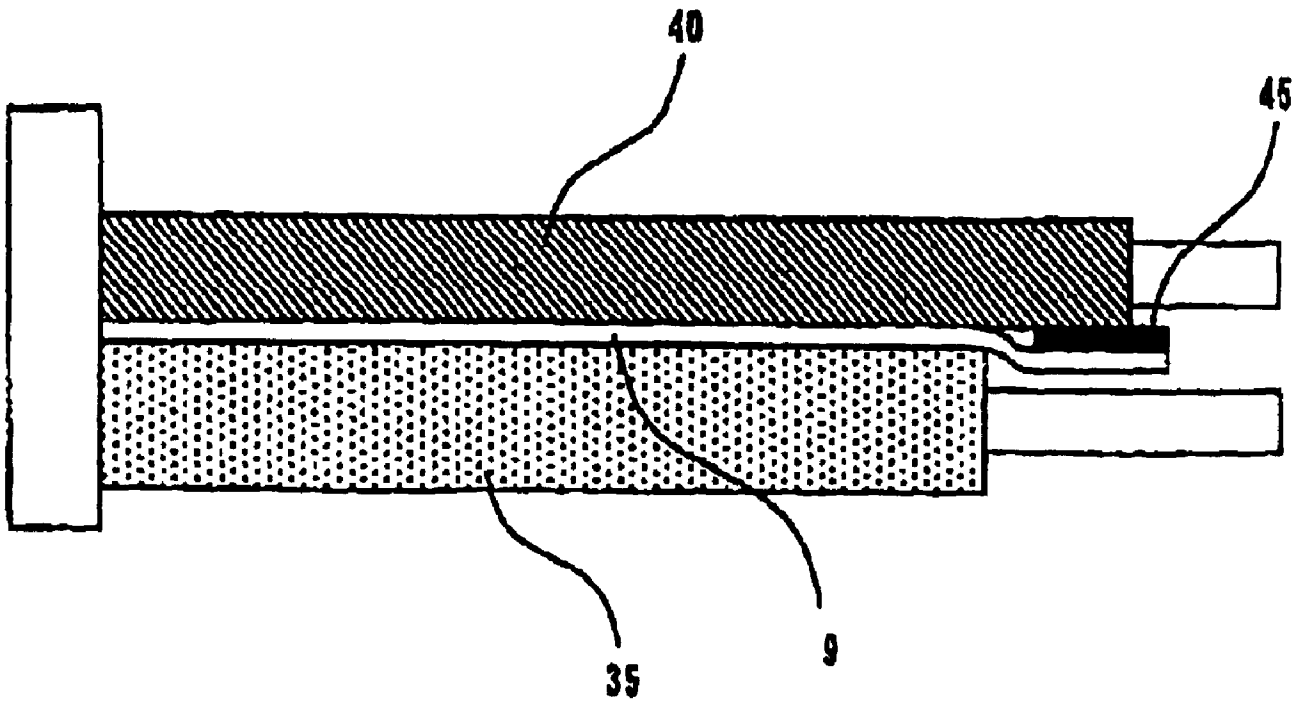
FIG. 5 is an illustration showing a length of an opposing roller.
Figure 6:
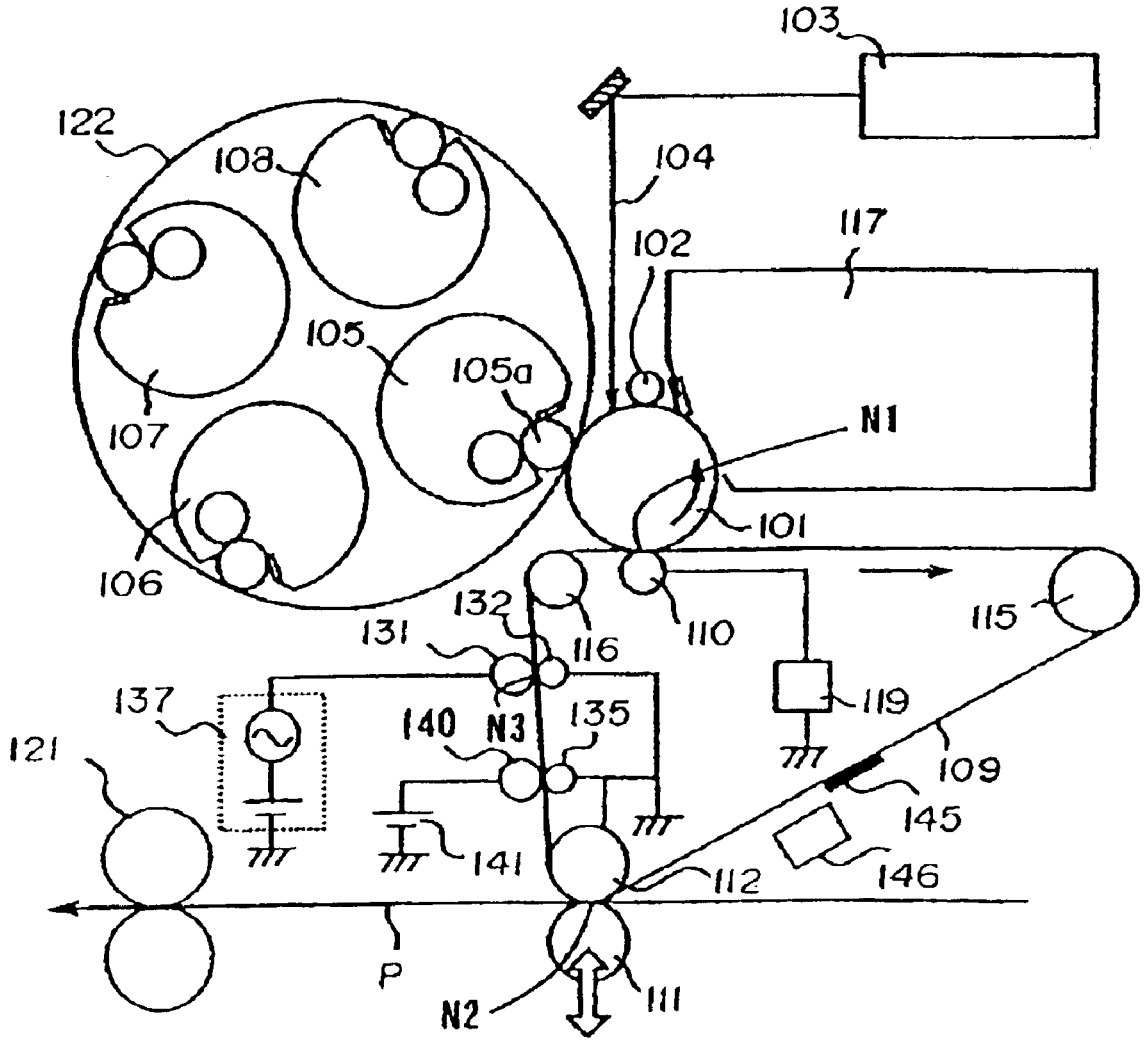
FIG.6 PRIOR ART
FIG. 6 is a diagram showing a conventional image forming apparatus.
Figure 7:
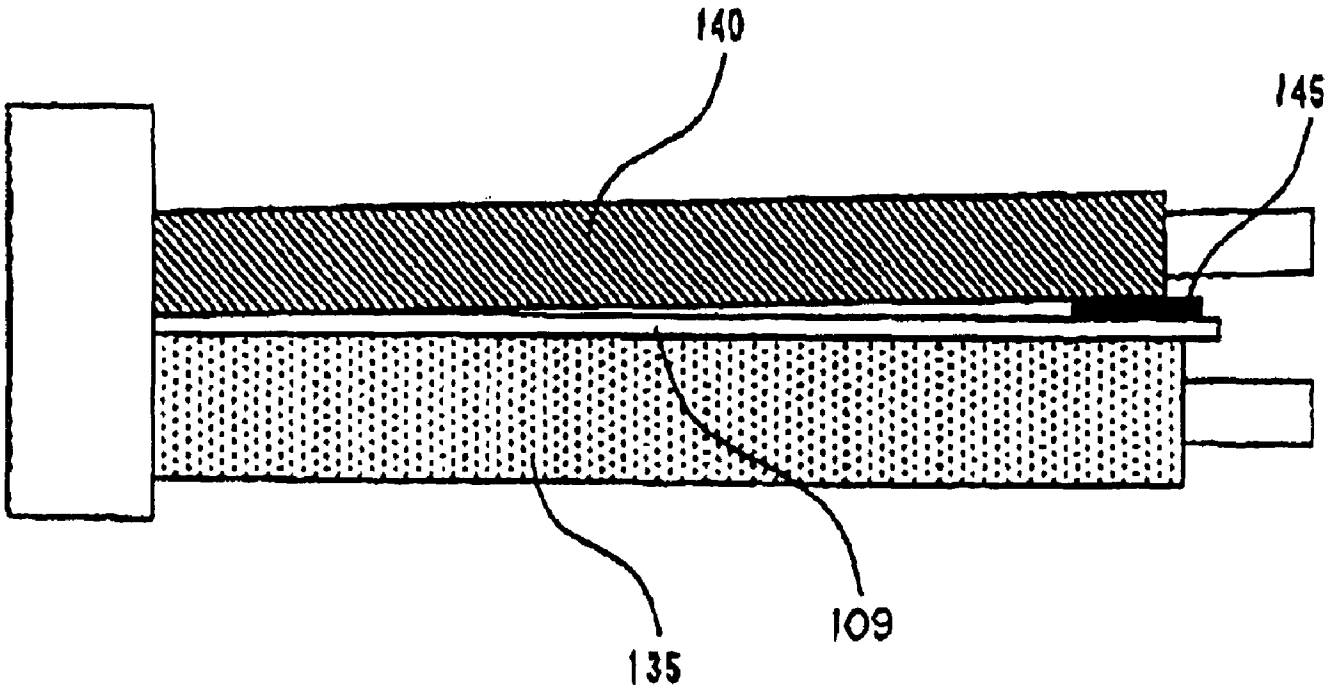
FIG.7 PRIOR ART
FIG. 7 is an illustration showing lengths of a charging roller and an opposing roller in a prior art.

FIG. 5 schematically illustrates the above positional relation. FIG. 5 shows a cross-sectional situation of the auxiliary charging roller 40 when cut at a plane containing the contact nipping region. In FIG. 5, numeral 9 denotes the intermediate transfer belt; numeral 40 denotes the auxiliary charging roller; numeral 35 denotes a roller (opposing roller) as the opposing electrode; numeral 45 denotes a cross section of the detection mark. It is to be noted that in this embodiment the contact nipping region of the auxiliary charging roller 40 is arbitrary, and shown herein is a case that the contact nipping region passes over the detection mark 45.

According to the structure of the intermediate transfer body cleaning mechanism of this embodiment, even where the auxiliary charging roller 40 is located on the detection mark 45, because the opposing roller 35 does not contact with the back surface of the detection mark portion, the detection mark portion can escape to the opposing roller side, and therefore, the auxiliary charging roller 40 does not float from the intermediate transfer belt 9 at the detection mark portion. That is, in this embodiment as substantially the same as in the first embodiment, even where an inexpensive roller having a high durability and a high hardness, possibly made compacter is used as the auxiliary charging roller, no charging defect occurs. In this embodiment, because the detection mark 45 can be cleaned up by the auxiliary charging roller 40, and can be charged.

It is to be noted that the features in the third embodiment can be combined with the first and second embodiments. That is, the contact nipping region between the auxiliary charging roller 40 and the intermediate transfer belt 9 and the contact nipping region between the opposing electrode 35 and the intermediate transfer belt 9, respectively can be structured not to pass through the detection mark.

Although in the above embodiments, the description is made using a so called four-path type image forming apparatus using a single photosensitive drum, this invention is applicable to an image forming apparatus of a tandem type as a basic structure of the apparatus as far as using substantially the same intermediate transfer body cleaning mechanism. In such a case, existence or non-existence of the contact isolation mechanism of the remaining toner charging roller and the auxiliary charging roller is arbitrary. This invention is also applicable where substantially the same mechanism is used for a cleaning method of a conveyance belt conveying the transfer material as absorbing the material.

Figure 3:
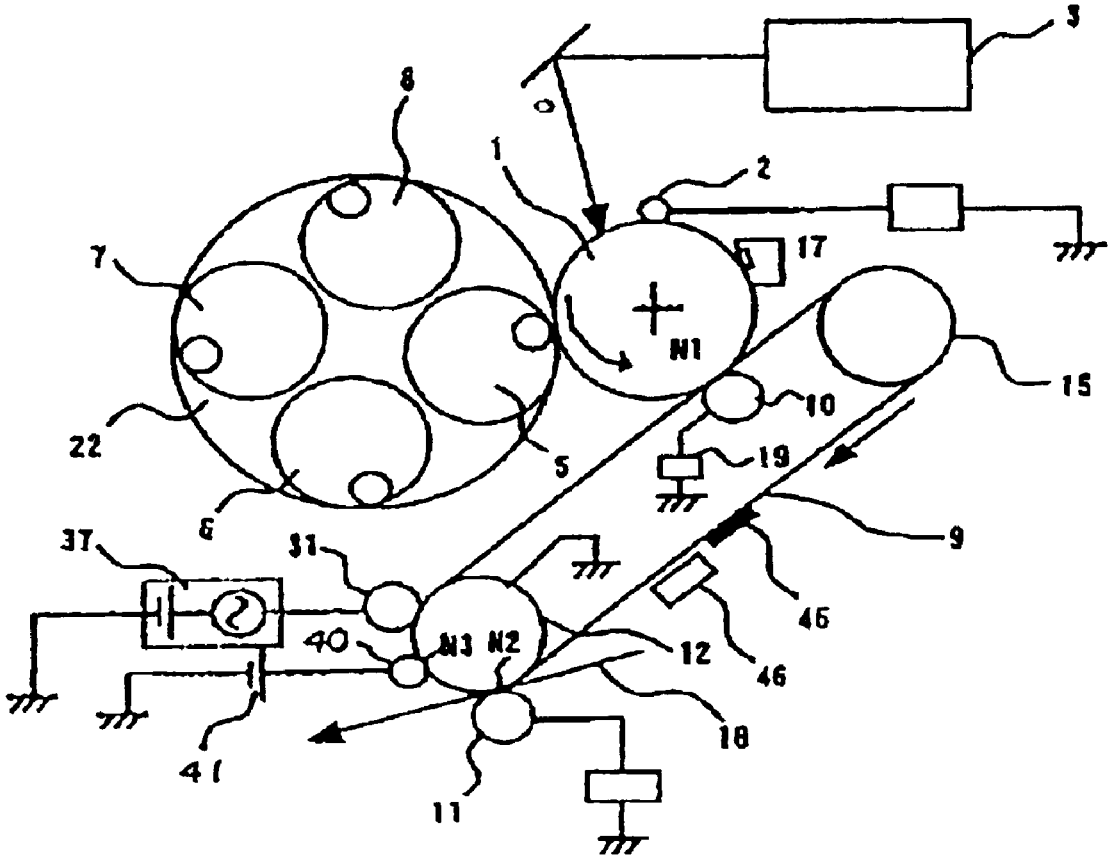
FIG. 3 is a diagram showing an image forming apparatus as another embodiment of the invention.

In a mean while, in the above first embodiment, as shown in FIG. 1, the opposing electrodes are described as formed respectively to the remaining toner charging roller 31, the auxiliary charging roller 40, and the secondary transfer roller 11. However, plural opposing electrodes can be used commonly. For example, as shown in FIG. 3, substantially the same advantages can be obtained even where the secondary transfer opposing roller 12 is used as the opposing electrode for the remaining toner charging roller 31 and the auxiliary charging roller 40. In the structure shown in FIG. 3, the advantageous points of the invention are remarkable where a smaller diameter of the auxiliary charging roller is sought from problems on space aspect such that the auxiliary charging roller comes closer to the conveyance route of the transfer material.

As described above, in this invention, even where a roller having a high hardness as the first charging means is used, and even where the contact pressure of the first charging means is low, floating can be prevented, and occurrence of charging defects can be prevented.

Although the embodiments according to this invention are described as above, the invention is not limited to the above embodiments, and any modification is possible within the scope of the technical conceptions of the invention.

What is claimed is:

1. An image forming apparatus comprising:

a first image bearing member for carrying a toner image; and a movable second image bearing member for carrying a toner image, wherein a toner image on said first image bearing member is transferred to said second image bearing member at a first transfer portion, and the toner image on said second image bearing member is transferred to a transfer material at a second transfer portion:

a charging member contacting to said second image bearing member and being arranged on a downstream side of said second transfer portion and on an upstream side of said first transfer portion in said moving direction of said second image bearing member; and a mark portion having a thickness and being formed on said image bearing member, wherein a contact region between said charging member and said second image bearing member does not overlap with said mark portion in a direction perpendicular to a moving direction of said second image bearing member.

2. The image forming apparatus according to claim 1, wherein said charging member includes a first end located on a side of said mark portion and a second end located on a side opposite to said first end in a direction perpendicular to a moving direction of said second image bearing member, and said first end is located on a side closer to said second end with respect to said mark portion.

3. The image forming apparatus according to claim 1, wherein said charging member has a surface hardness of 45 degrees or more (JIS-A).

4. The image forming apparatus according to claim 1, wherein said mark portion is a sheet member adhered onto said second image bearing member.

5. The image forming apparatus according to claim 1, wherein said mark portion has a thickness of 30 microns or more.

6. The image forming apparatus according to claim 1, wherein said mark portion has an opening formed on said second image bearing member and a sheet member covering said opening.

7. The image forming apparatus according to claim 1, wherein said charging member and said mark portion are arranged on a side of a toner image carrying surface of said second image bearing member.

8. The image forming apparatus according to claim 1, wherein said charging member is a first charging member, and further comprising a second charging member arranged on a downstream side of said first charging member and on an upstream side of said first transfer portion in a moving direction of said second image bearing member, and wherein said contact region between said second charging member and said second image bearing member overlaps with said mark portion in a direction perpendicular to a moving direction of said second image bearing member.

9. The image forming apparatus according to claim 8, wherein said second charging member includes a first end located on a side of said mark portion and a second end located on a side opposite to said first end in a direction perpendicular to a moving direction of said second image bearing member, and said first end is located on a side opposite to said second end with respect to said mark portion.

10. The image forming apparatus according to claim 8, wherein said second charging member has a surface hardness of 45 degrees of less (JIS-A).

11. The image forming apparatus according to claim 8, wherein said second charging member is applied with an alternative current voltage in which a direct current voltage is convoluted with an alternative current voltage.

12. The image forming apparatus according to claim 1, wherein said charging member is applied with a voltage for supplying a toner remaining on said second image bearing member passing through said second transfer portion with electric charges having a polarity reverse to a normal polarity of a toner.

13. The image forming apparatus according to claim 12, wherein a voltage applied to said charging member is a direct current voltage.

14. The image forming apparatus according to claim 1, further comprising a cleaning means for collecting toner on said first image bearing member, wherein a toner on said second image bearing member is moved to said first image bearing member at said first transfer portion and then collected by said cleaning means.

15. An image forming apparatus comprising:

a first image bearing member for carrying a toner image; and a movable second image bearing member for carrying a toner image, wherein a toner image on said first image bearing member is transferred to said second image bearing member at a first transfer portion, and the toner image on said second image bearing member is transferred to a transfer material at a second transfer portion;

a charging member contacting to said second image bearing member and being arranged on a downstream side of said second transfer portion and on an upstream side of said first transfer portion in a moving direction of a second image bearing member;

an opposing member opposing said charging member via said second image bearing member and contacting to said second image bearing member; and a mark portion having a thickness and being formed on said image bearing member, wherein a contact region between said opposing member and said second image bearing member does not overlap with said portion in a direction perpendicular to a moving direction of said image bearing member.

16. The image forming apparatus according to claim 15, wherein said opposing member includes a first end located on a side of said mark portion and a second end located on a side opposite to said first end in a direction perpendicular to a moving direction of said second image bearing member, and said first end is located on a side closer to said second end with respect to said mark portion.

17. The image forming apparatus according to claim 15, wherein said mark portion is a sheet member adhered onto said second image bearing member.

18. The image forming apparatus according to claim 15, wherein said mark portion has a thickness of 30 microns or more.

19. The image forming apparatus according to claim 15, wherein said mark portion has an opening formed on said second image bearing member and a sheet member covering said opening.

20. The image forming apparatus according to claim 15, wherein said mark portion is arranged on a surface on a toner image carrying side of said second image bearing member, and said opposing member is arranged on a surface on a side opposite to a toner image carrying side of said second image bearing member.

21. The image forming apparatus according to claim 15, wherein a contact region between said charging member and said second image bearing member overlaps with said mark portion in a direction perpendicular to a moving direction of said second image bearing member.

22. The image forming apparatus according to claim 21, wherein said charging member includes a first end located on a side of said mark portion and a second end located on a side opposite to said first end in a direction perpendicular to a moving direction of said second image bearing member, and said first end is located on a side opposite to said second end with respect to said mark portion.

23. The image forming apparatus according to claim 15, wherein said charging member is applied with a voltage for supplying a toner remaining on said second image bearing member passing through said second transfer portion with electric charges having a polarity reverse to a normal polarity of a toner.

24. The image forming apparatus according to claim 23, wherein a voltage applied to said charging member is a direct current voltage.

25. The image forming apparatus according to claim 15, and further comprising a cleaning means for collecting toner on said first image bearing member, wherein a toner on said second image bearing member is moved to said first image bearing member at said first transfer portion and then collected by said cleaning means.

* * * * *

UNITED STATES PATENT AND TRADEMARK OFFICE

CERTIFICATE OF CORRECTION

PATENT NO. : 6,934,499 B1
APPLICATION NO. : 10/668302
DATED : August 23, 2005
INVENTOR(S) : Sato et al.

It is certified that error appears in the above-identified patent and that said Letters Patent is hereby corrected as shown below:

COLUMN 1
Line 20, “melt” should read --melted--.
Line 62, “melt” should read --melted--.

COLUMN 2
Line 11, “So called” should read --So-called--.
Line 13, “containing such as” should read --containing, for example,--.

COLUMN 3
Line 26, “maybe” should read --may be--.
Line 61, “a” should read --the--.

COLUMN 4
Line 3, “as not” should read --as not to cause the belt to be loosened. Such a roller can adequately work as the--.

COLUMN 5
Line 26, “radiate” should read --radiates--.

COLUMN 6
Line 33, “filers.” should read --fillers.--.

COLUMN 7
Line 22, “use” should read --used--.
Line 34, “consists” should read --contacts--.
Line 35, “to” should be deleted.

COLUMN 8
Line 52, “Through” should read --Though--.
Line 53, “unlikely” should read --unlikely to be--.

COLUMN 9
Line 3, “rollers” should read --roller--.
Line 32, “compacter,” should read --more compact,--.

COLUMN 10
Line 30, “compacter” should read --more compact,--.

UNITED STATES PATENT AND TRADEMARK OFFICE

CERTIFICATE OF CORRECTION

PATENT NO. : 6,934,499 B1
APPLICATION NO. : 10/668302
DATED : August 23, 2005
INVENTOR(S) : Sato et al.

It is certified that error appears in the above-identified patent and that said Letters Patent is hereby corrected as shown below:

COLUMN 11
Line 24, "compacter" should read --more compact,--.
Line 26, "because" should be deleted.
Line 48, "In a mean while," should read --Meanwhile,--.

COLUMN 13
Line 6, "of" should read --or--.

Signed and Sealed this

Seventeenth Day of October, 2006

JON W. DUDAS
*Director of the United States Patent and Trademark Office*